US008764075B2

(12) United States Patent
Taurasi et al.

(10) Patent No.: US 8,764,075 B2
(45) Date of Patent: Jul. 1, 2014

(54) DOUBLE PAWL VEHICLE LATCH

(75) Inventors: Marco Taurasi, Leghorn (IT); Franceso Cumbo, Pisa (IT)

(73) Assignee: MAGNA Closures, S.p.A., Collesalvetti (IT)

( * ) Notice: Subject to any disclaimer, the term of this patent is extended or adjusted under 35 U.S.C. 154(b) by 551 days.

(21) Appl. No.: 12/994,816

(22) PCT Filed: May 26, 2009

(86) PCT No.: PCT/EP2009/003694

§ 371 (c)(1),
(2), (4) Date: Nov. 26, 2010

(87) PCT Pub. No.: WO2009/143997

PCT Pub. Date: Dec. 3, 2009

(65) Prior Publication Data

US 2011/0074166 A1 Mar. 31, 2011

Related U.S. Application Data

(60) Provisional application No. 61/056,024, filed on May 26, 2008, provisional application No. 61/138,978, filed on Dec. 19, 2008.

(51) Int. Cl.
*E05C 3/16* (2006.01)

(52) U.S. Cl.
USPC ..... 292/216; 292/201; 292/DIG. 23

(58) Field of Classification Search
USPC ..... 292/216, 201, DIG. 23
See application file for complete search history.

(56) References Cited

U.S. PATENT DOCUMENTS 5,934,717 A * 8/1999 Wirths et al. ..... 292/201
6,048,002 A * 4/2000 Ohta et al. ..... 292/201

(Continued)

FOREIGN PATENT DOCUMENTS

DE 10048709 A1 4/2002
DE 10331497 A1 7/2003
DE 20307347 U1 11/2004
DE 10312304 B4 12/2005
DE 102005043227 B3 4/2007

(Continued)

*Primary Examiner* — Kristina Fulton
*Assistant Examiner* — Christine M Mills
(74) *Attorney, Agent, or Firm* — Dickinson Wright PLLC

(57) ABSTRACT

A vehicle latch including a ratchet (18), a first pawl (20), a cam (22), a second pawl (24) and a drive mechanism (50,52, 54,56,58). The ratchet is movable between a striker (12) release position wherein the ratchet is positioned to receive a striker, and a striker holding position wherein the ratchet is positioned to retain the striker. The ratchet is biased to the striker release position. The first pawl is movable between a ratchet locking position wherein the first pawl is positioned to hold the ratchet in the striker holding position, and a ratchet release position wherein the first pawl permits the movement of the ratchet out of the striker holding position. The first pawl is biased towards the ratchet locking position. The cam is operatively connected to the first pawl, wherein the cam is movable between an first pawl enabling position in which the first pawl is enabled to move to the ratchet locking position, and a first pawl disabling position in which the cam positions the first pawl in the ratchet release position. The cam is biased towards the first pawl disabling position. The second pawl is movable between a cam locking position in which the second pawl is positioned to hold the cam in the first pawl enabling position, and a cam release position wherein the second pawl is positioned to permit the movement of the cam to the first pawl disabling position. The second pawl is biased towards the cam locking position. The drive mechanism is configured for moving the second pawl into the cam release position.

32 Claims, 16 Drawing Sheets

(56) References Cited

U.S. PATENT DOCUMENTS

| | | | | |
|---|---|---|---|---|
| 6,659,515 | B2 * | 12/2003 | Raymond et al. | 292/201 |
| 6,698,804 | B2 | 3/2004 | Shiota et al. | |
| 6,817,636 | B1 | 11/2004 | Evans et al. | |
| 7,261,333 | B2 * | 8/2007 | Tomaszewski | 292/201 |
| 7,467,815 | B2 * | 12/2008 | Larsen et al. | 292/201 |
| 2005/0200137 | A1 | 9/2005 | Nelsen et al. | |
| 2005/0206172 | A1 | 9/2005 | Bacon | |
| 2005/0212302 | A1 | 9/2005 | Fisher | |
| 2006/0076784 | A1 * | 4/2006 | Kachouh et al. | 292/216 |
| 2008/0073918 | A1 * | 3/2008 | Arabia et al. | 292/201 |
| 2010/0244466 | A1 * | 9/2010 | Tomaszewski | 292/201 |

FOREIGN PATENT DOCUMENTS

| | | | |
|---|---|---|---|
| DE | 202006012091 | U1 | 12/2007 |
| DE | 19943483 | B4 | 3/2008 |
| DE | 102007060915 | A1 | 6/2009 |
| DE | 102008028255 | A1 | 12/2009 |
| DE | 102008028256 | A1 | 12/2009 |
| DE | 102008039240 | A1 | 2/2010 |
| EP | 1096087 | B1 | 10/2000 |
| EP | 1241305 | B1 | 11/2004 |
| EP | 1862618 | B1 | 7/2009 |
| WO | 0102677 | A2 | 1/2001 |
| WO | 2006/087578 | A1 | 8/2006 |

* cited by examiner

DOUBLE PAWL VEHICLE LATCH

FIELD OF THE INVENTION

The present invention relates to closure latches for vehicles, and more particularly to a closure latch for a vehicle door.

BACKGROUND OF THE INVENTION

An issue relating to vehicle door latches is that it is sometimes desirable to have low effort required to release the ratchet from the striker. Another issue relating to vehicle door latches is that is sometime desirable to have a low effort release to engage (ie. close) the latch. Another issue relating to vehicle door latches is that the release time for the latch may not be consistent from latch to latch due to manufacturing tolerances of the vehicle, and/or the release time can change over time, as certain components age. As another consideration, it is advantageous to provide a door latch that is capable of quickly releasing the ratchet from the striker, but it is also advantageous for the door latch to be capable of providing a high force to open the latch in the event it is needed. For example, if the vehicle is in an accident, it is possible that a high force would be required to open the latch. This is particularly true for electrical latches that do not have a mechanical linkage that can be actuated as a backup for opening the latch.

SUMMARY OF THE INVENTION

In a first aspect, the invention is directed to a vehicle latch including a ratchet, a first pawl, a cam, a second pawl and a drive mechanism.

In a particular embodiment of the first aspect, the ratchet is movable between a striker release position wherein the ratchet is positioned to receive a striker, and a striker holding position wherein the ratchet is positioned to retain the striker. The ratchet is biased to the striker release position. The first pawl is movable between a ratchet locking position wherein the first pawl is positioned to hold the ratchet in the striker holding position, and a ratchet release position wherein the first pawl permits the movement of the ratchet out of the striker holding position. The first pawl is biased towards the ratchet locking position. The cam is operatively connected to the first pawl, wherein the cam is movable between an first pawl enabling position in which the first pawl is enabled to move to the ratchet locking position, and a first pawl disabling position in which the cam positions the first pawl in the ratchet release position. The cam is biased towards the first pawl disabling position. The second pawl is movable between a cam locking position in which the second pawl is positioned to hold the cam in the first pawl enabling position, and a cam release position wherein the second pawl is positioned to permit the movement of the cam to the first pawl disabling position. The drive mechanism is configured for moving the second pawl into the cam release position.

The drive mechanism may optionally be configured to move to permit the movement of the second pawl (eg. by means of a second pawl biasing member) from the cam release position to the cam locking position. The drive mechanism may further be optionally be configured to positively drive the movement of the second pawl from the cam release position to the cam locking position.

BRIEF DESCRIPTION OF THE DRAWINGS

The present invention will now be described by way of example only with reference to the attached drawings, in which.

DETAILED DESCRIPTION OF THE INVENTION

Figure 1:
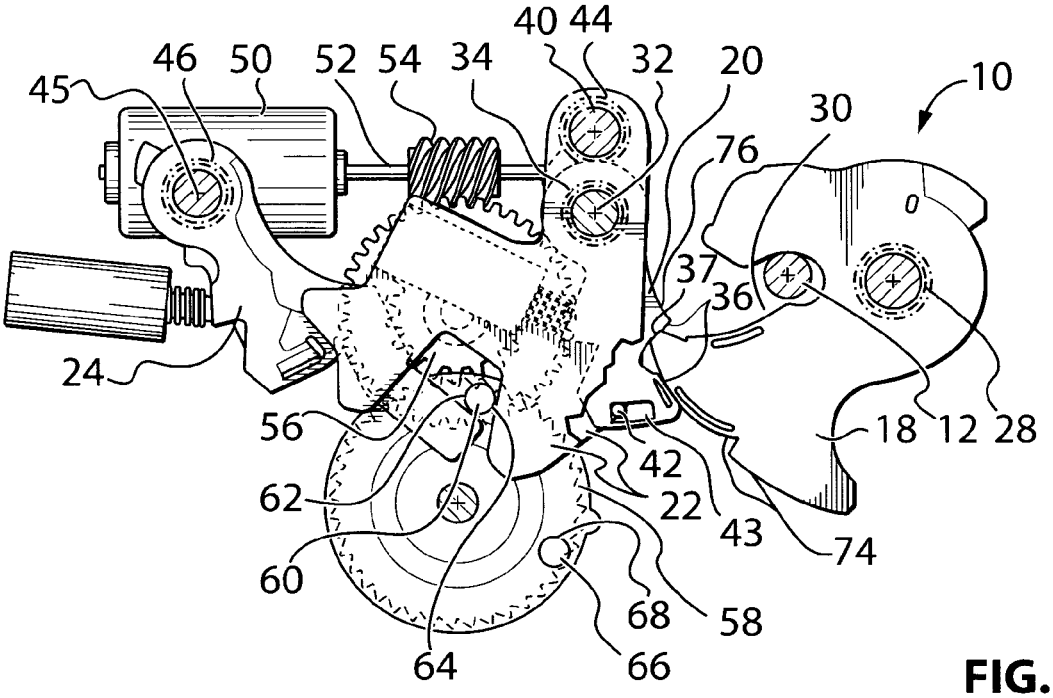
FIG. 1 is a perspective view of a vehicle latch in accordance with an embodiment of the present invention.

Reference is made to FIG. 1, which shows a vehicle latch 10, for receiving and holding a striker 12. The vehicle latch 10 may be mounted on a vehicle closure panel such as a vehicle door (not shown), while the striker 12 may be mounted on a vehicle body (not shown). Alternatively, the vehicle latch 10 may be mounted on the vehicle body and the striker 12 may be mounted on the vehicle closure panel (eg. vehicle door).

The latch 10 includes a ratchet 18, a first pawl 20, a cam 22 and a second pawl 24. The ratchet 18 is pivotally mounted to a latch housing (not shown) the vehicle door for pivotal movement about a ratchet pivot axis shown at 26. The ratchet 18 is movable between a striker release position (FIG. 2*c*) wherein the ratchet 18 is positioned to receive the striker 12, and a striker holding position (FIG. 2*a*) wherein the ratchet 18 is positioned to retain the striker 12. The ratchet 18 is biased towards the striker release position by a ratchet biasing member 28, which may be, for example, a torsion spring.

The ratchet 18 includes a slot 30 that is configured to hold the striker 12 when the ratchet 18 is in the striker holding position (FIG. 2*a*), thereby preventing the striker 12 from being withdrawn from the ratchet 18. The slot 30 is also configured to cooperate with the striker 12 such that when the striker 12 is initially received in the slot 30, the striker 12 urges the rotation of the ratchet 18 towards its striker holding position (FIG. 2*a*).

The first pawl 20 is pivotally mounted to the cam 22 for movement about a first pawl pivot axis shown at 32. The first pawl 20 is movable between a ratchet locking position (FIG. 2*a*) wherein the first pawl 32 holds the ratchet 18 in the striker holding position (FIG. 2*a*), and a ratchet release position (FIG. 2*c*) wherein the first pawl 20 permits the movement of the ratchet 18 out of the striker holding position. The first pawl 20 is biased towards the ratchet locking position (FIG. 2*a*) by a first pawl biasing member 34, which may be, for example, a torsion spring.

Figure 2A:
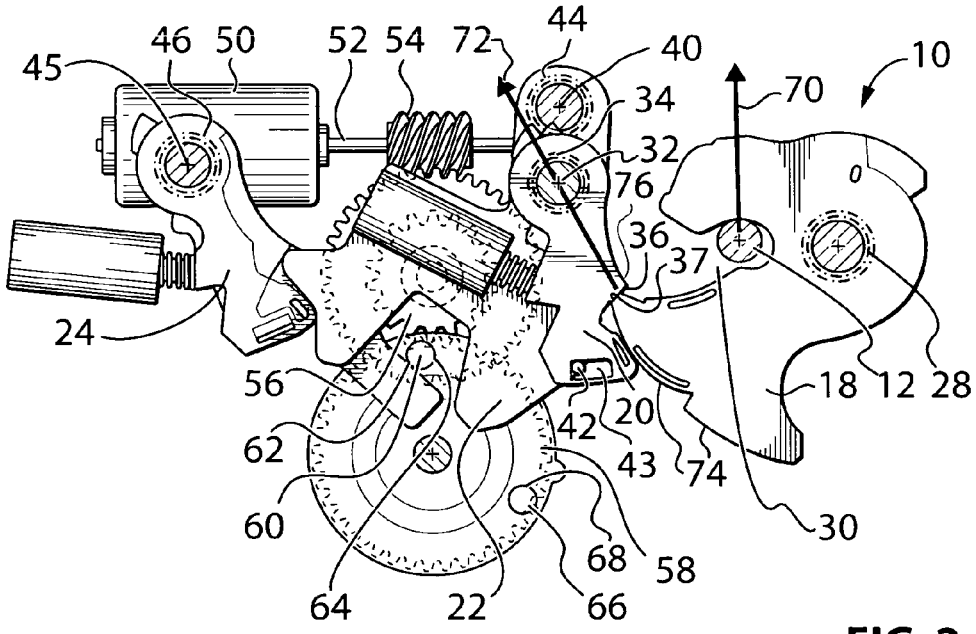
FIG. 2*a* is a side view of the vehicle latch shown in FIG. 1, in a latch closed position.

The first pawl 20 includes a first pawl locking surface 36 which engages a ratchet locking surface 37 to lock the ratchet 18 in the striker holding position (FIG. 2*a*).

Figure 2B:
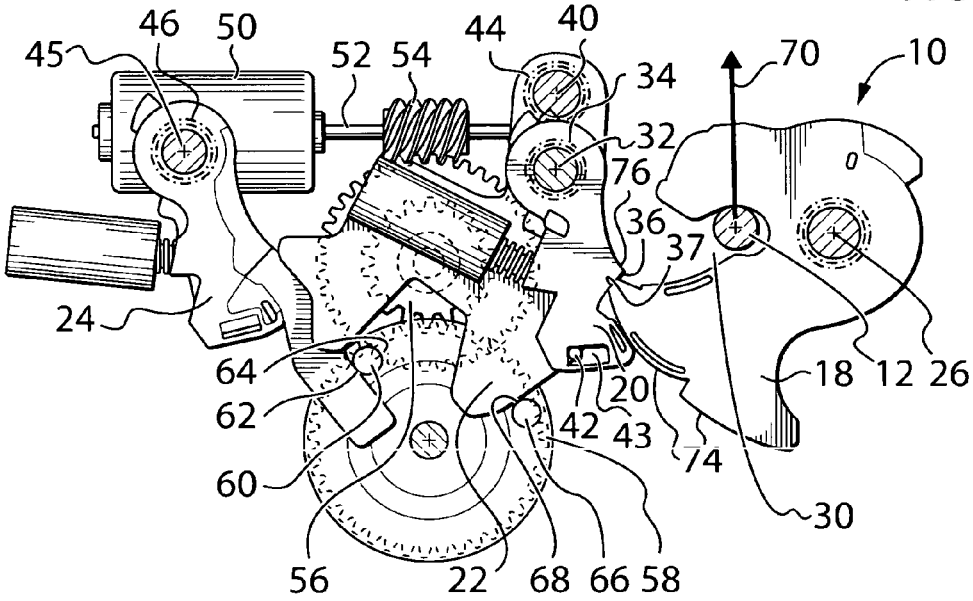
FIG. 2*b* is a side view of the vehicle latch shown in FIG. 1, in a partially actuated state.
Figure 2C:
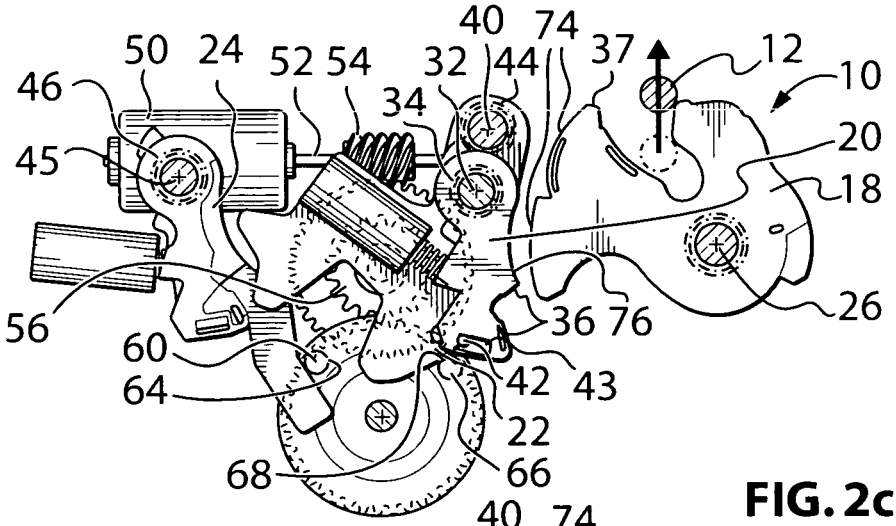
FIG. 2*c* is a side view of the vehicle latch shown in FIG. 1, in a latch open position.
Figure 2D:
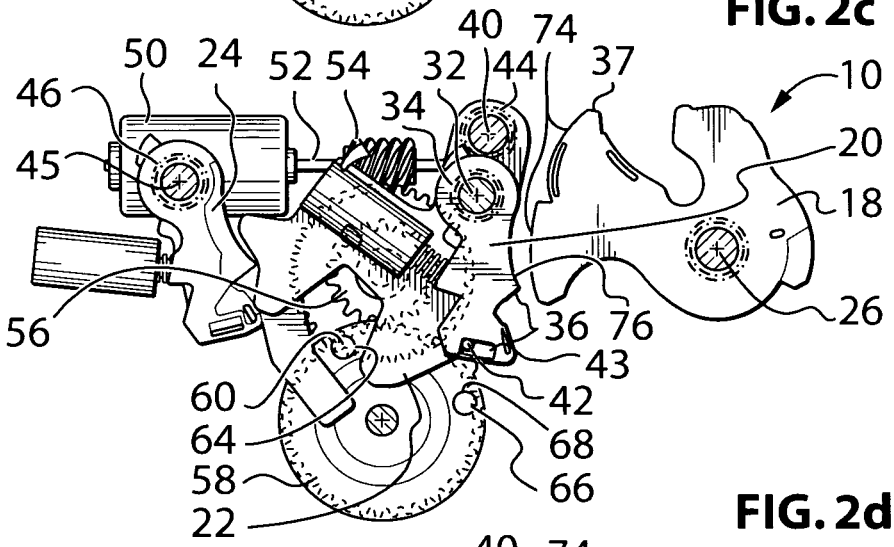
FIG. 2*d* is a side view of the vehicle latch shown in FIG. 1, in another partially actuated state.
Figure 2E:
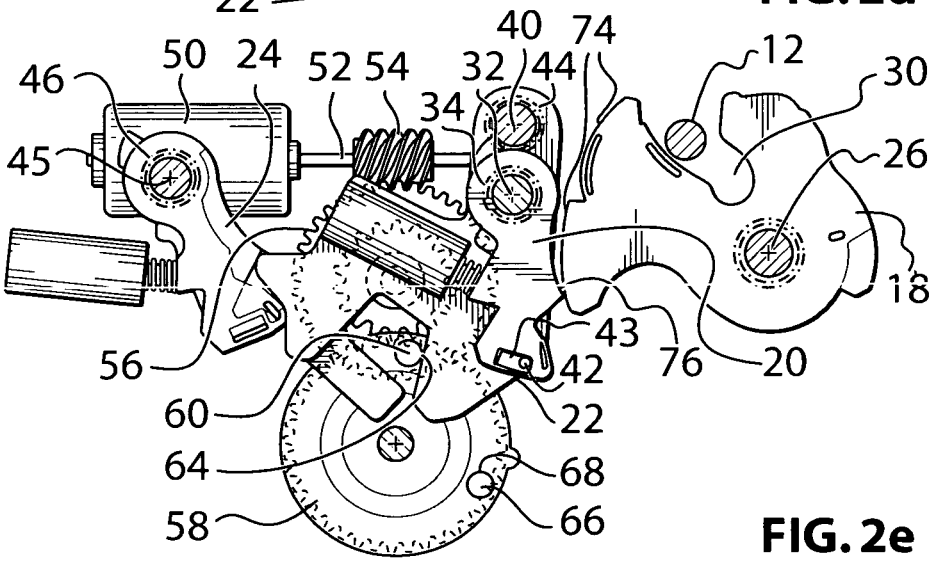
FIG. 2*e* is a side view of the vehicle latch shown in FIG. 1, in a latch reset position.

The cam 22 is pivotally mounted to the latch housing (not shown) about a cam pivot axis 40 for movement between a first pawl disabling position (FIG. 2*c*) wherein the cam 22 positions the first pawl 20 in the ratchet release position, and a first pawl enabling position wherein the cam 22 is reset, as shown in FIG. 2*e* and as described in greater detail below. As seen in FIG. 2*a*, a cam pin 42 on the cam 22 cooperates with a slot 43 on the first pawl 20 to limit the rotation of the first pawl 20 relative to the cam 22. Because the position of the cam 22 thus controls at least to some extent the position of the first pawl 20, the cam 22 may be said to be operatively connected to the first pawl 20.

The cam 22 may be biased towards the first pawl disabling position by a cam biasing member 44, which may be, for example, a torsion spring.

The second pawl 24 is pivotally mounted to the latch housing (not shown) about a second pawl pivot axis 45 for movement between a cam locking position (FIG. 2*a*) wherein the second pawl 24 is positioned to hold the cam 22 in the first pawl enabling position, and a cam release position (FIG. 2*c*) wherein the second pawl 24 is positioned to permit the movement of the cam 22 out of the first pawl enabling position.

The second pawl 24 is biased towards the cam locking position by a second pawl biasing member 46, which may be, for example, a torsion spring.

The latch 10 shown in the figures includes a drive mechanism 48, which may include, for example, a motor 50 with an output shaft 52, a worm gear 54 mounted on the output shaft 52, and a speed reduction arrangement of first and second spur gears 56 and 58, which are driven by the worm gear 54. The second spur gear 58 is the final gear in the drive mechanism and may thus be referred to as the final gear 58. The second gear 58 includes a first pin 60 which is a second pawl engagement member 62 and which is also a first cam engagement member 64, whose functions are described further below. The second spur gear 58 further includes a second pin 66 which is a second cam engagement member 68, whose function is described further below. As a result of the second pawl engagement member 62, the motor 50 is operatively connected to the second pawl 24 to drive the second pawl 24 from the cam locking position (FIG. 2*a*) to the cam release position (FIG. 2*c*). As a result of the first cam engagement member 64, the motor 50 is operatively connected to the cam 22 to drive the cam 22 from the first pawl disabling position to the first pawl enabling position. As a result of the second cam engagement member 68, the motor 50 is operatively connected to the cam 22 to drive the cam 22 from the first pawl enabling position to the first pawl disabling position.

While a drive mechanism 48 having a motor 50 is shown in the figures, it is alternatively possible for the opening of the latch 10 to be carried out manually, using cables, rods or any other suitable mechanical elements that are directly or indirectly actuated by a user. In a preferred embodiment, however, the latch 10 is an electrical latch in the sense that it is not mechanically operated by means of a door release handle (not shown); it is operated by an electric motive source, such as the motor 50.

The operation of the latch 10 is described with reference to FIGS. 2*a*-2*e*. Reference is made to clockwise and counterclockwise rotation. It will be understood that such reference is made based on the views illustrated in FIGS. 2*a*-2*e*, and is made solely to assist a person in understanding the operation of the elements shown in the figures. Such references to rotational direction are not to be taken as limiting.

In FIG. 2*a*, the latch 10 is in a latch closed position and holds the striker 12. Thus, the ratchet 18 is in the striker holding position; the first pawl 20 is in the ratchet locking position; the cam 22 is in the first pawl enabling position, and the second pawl 24 is in the cam locking position. When the vehicle door is closed a door seal that is present on either the vehicle body or on the vehicle door itself may be compressed. As a result of the compression of the door seal, the door seal exerts a force urging the vehicle door open. As a result, the striker 12 exerts a first force F1, which may be referred to as the seal force, on the ratchet 18 along force direction line 70 (FIG. 2*a*).

The first force F1 generates a first moment M1 that is clockwise on the ratchet 18. In addition, a second moment M2 that is clockwise is generated on the ratchet 18 by the ratchet biasing member 28. The moments M1 and M2 result in a second force F2 being exerted from the ratchet 18 into the first pawl 20, and more particularly from the ratchet locking surface 37 into the first pawl locking surface 36, along force direction line 72 (FIG. 2*a*). The second force F2 extends in a direction that may pass at least approximately through the first pawl pivot axis 32, thereby generating approximately no moment on the first pawl 20. However, the second force F2 generates a third moment M3 that is clockwise, which is exerted on the cam 22. The third moment M3 may be relatively small, as the force direction line 72 extends proximate to the cam pivot axis 40.

In addition to the third moment M3 that results from engagement with the ratchet 18, the cam biasing member 44 exerts a fourth moment M4 that is clockwise on the cam 22. The moments M3 and M4 result in a clockwise moment M5 on the cam 22. Thus, the cam 22 is biased toward the first pawl disabling position by the cam biasing member 44 and by the moment M3 resulting from the first force F1.

To release the striker 12 from the closed latch 10, the motor 50 is actuated in a first rotational direction which turns the worm gear 54. The rotation of the worm gear 54 turns the first spur gear 56 in a clockwise direction. The first spur gear 56 turns the second spur gear 58 to rotate counterclockwise. The second pawl engagement member 62 on the second spur gear 58 engages the second pawl 24 and rotates the second pawl 24 clockwise against the second pawl biasing member 46 to the cam release position (FIG. 2*c*), thereby permitting the cam 22 to rotate out of its first pawl enabling position.

Since the clockwise rotation of the cam 22 is no longer resisted by the second pawl 24, the moment M5 on the cam 22 urges the cam 22 to rotate clockwise to its first pawl disabling position, thereby bringing the first pawl 20 out of engagement with the ratchet 18, which in turn permits the ratchet 18 to rotate clockwise to the striker release position (FIG. 2*c*) under the urging of the striker 12 and under the influence of the ratchet biasing member 28, for separation of the ratchet 18 and the striker 12 from each other (eg. for withdrawal of the ratchet 18 from the striker 12 as the vehicle door (not shown) is opened), thereby bringing the vehicle latch 10 to the latch open position shown in FIG. 2*c*.

Thus, a relatively low effort is required by the motor 50 in order to move the vehicle latch 10 to the latch open position (FIG. 2*c*), since the motor 50 has only to move the second pawl 24 to the cam release position. This is advantageous as it reduces the size of the motor 50 required. Additionally, it is contemplated that a backup latch release system could be provided to open the vehicle latch 10. The backup latch release system would include a battery that may be door-mounted to provide power to the motor 50 if the main vehicle battery fails to provide power, eg. if the vehicle has been involved in an accident. Reducing the effort needed to open the vehicle latch 10 reduces the size and weight of the battery that would be required for this task.

It will be noted that, in the latch closed position shown in FIG. 2*a*, the second gear 58 is positioned so that the second pawl engagement member 62 on the first pin 60 is engaged with the second pawl 24. As a result, as soon as the motor 50 causes the second gear 58 to rotate in the first direction (ie. counter-clockwise), the second pawl engagement member 62 initiates movement of the second pawl 24 away from the cam locking position. Accordingly, the action to release the ratchet 18 from the striker 12 takes place relatively quickly. This quick releasing action can take place even where there is a relatively high gear reduction that occurs in the drive mechanism.

Due to several factors, such as, for example, manufacturing tolerances during production of the vehicle (not shown), or, for example, aging of the door seal (not shown) over time, it is possible that the degree of compression that takes place in the door seal may be relatively small, or it may be that the resistance to compression of the door seal may be relatively small. As a result of such factors, the force F1 and the force generated by the cam biasing member 44 may result in a moment M5 that is too small to overcome whatever resistance to movement exists in the latch 10. Accordingly, movement of the second pawl 24 out of engagement of the cam 22 may not result in movement of the cam 22 to its first pawl disabling position, which would mean that the ratchet 18 would remain locked about the striker 12. Alternatively, the moment M5 may be sufficient to move the cam 22 to the first pawl disabling position, but may not be of sufficient magnitude to accomplish the movement quickly. To address these issues, rotation of the second spur gear 58 causes the second cam engagement member 68 to engage the cam 22 and drive the cam 22 clockwise once the second pawl 24 is clear of the path of the cam 22, as shown in FIG. 2*b*. Even if the motor 50 is needed to urge the cam 22 towards the first pawl disabling position, the presence of the cam biasing member 44 and the seal force F1 each reduces the effort that would otherwise be needed by the motor 50 to move the cam 22.

After the latch 10 has reached the open position shown in FIG. 2*c*, the motor 50 may be rotated by a selected amount in the opposite direction to that which brought the latch 10 to the open position. As a result, the second gear 58 rotates in the second direction and moves the first cam engagement member 64 to engage the cam 22 and drive the cam 22 counterclockwise towards the first pawl enabling position, as shown in FIG. 2*e*.

Movement of the second gear 58 away from the position shown in FIG. 2*c* permits the second pawl 24 to rotate counterclockwise towards its cam locking position under the influence of the second pawl biasing member 46. When the first cam engagement member 64 has urged the cam 22 back to (and slightly past) its first pawl enabling position, the second pawl 24 moves back to the cam locking position (FIG. 2*e*) under the influence of the second pawl biasing member 46. Once the second pawl 24 has reached the cam locking position, the motor 50 may be operated to permit the cam 22 to move (clockwise in the view shown in the figures) to its first pawl enabling position where it is held by the second pawl 24. Thus, the first pawl 20 is urged towards the ratchet locking position (by the force of the first pawl biasing member 34), however the ratchet 18 remains in the striker release position (FIG. 2*e*). The first pawl 20 is at this point in the first pawl reset position. The latch position shown in FIG. 2*e* may be referred to as the latch reset position.

The ratchet 18 has a ratchet camming surface 74 thereon that is configured to cooperate with a first pawl camming surface 76 to permit the ratchet to rotate to (and past) its striker holding position when the first pawl 20 is in the first pawl reset position.

When the striker 12 enters the slot 30 in the ratchet 18, the striker 12 (FIG. 2*e*) urges the ratchet 18 in a counterclockwise direction. The first pawl 24 accommodates the movement by rotating clockwise about the first pawl pivot 32 against the bias of the first pawl biasing member 34 as a result of engagement with the ratchet camming surface 74. As the vehicle door continues to close, the striker 12 (FIG. 2*e*) rotates the ratchet 18 further counterclockwise towards the striker holding position. Once the striker 12 has pushed the ratchet 18 to (and slightly past) the striker holding position, the first pawl 20 moves to the ratchet locking position under the influence of the first pawl biasing member 34. The compression of the door seal and the ratchet biasing member 34 urge the striker 12 to pull the ratchet 18 back to its striker holding position whereat it engages the first pawl. The ratchet 18 is held by the first pawl 20 in the striker holding position to retain the striker 12 in the slot 30. The latch 10 is at this point in the latch closed position, shown in FIG. 2*a*.

Setting the second pawl 24 in the cam locking position and the cam 22 in the first pawl enabling position prior to engagement between the striker 12 and the ratchet 18 reduces the force that might otherwise be required to move the ratchet 18 to the striker holding position, relative to some double pawl latches wherein the engagement of the striker and ratchet causes rotation of several additional latch components.

Figure 3A:
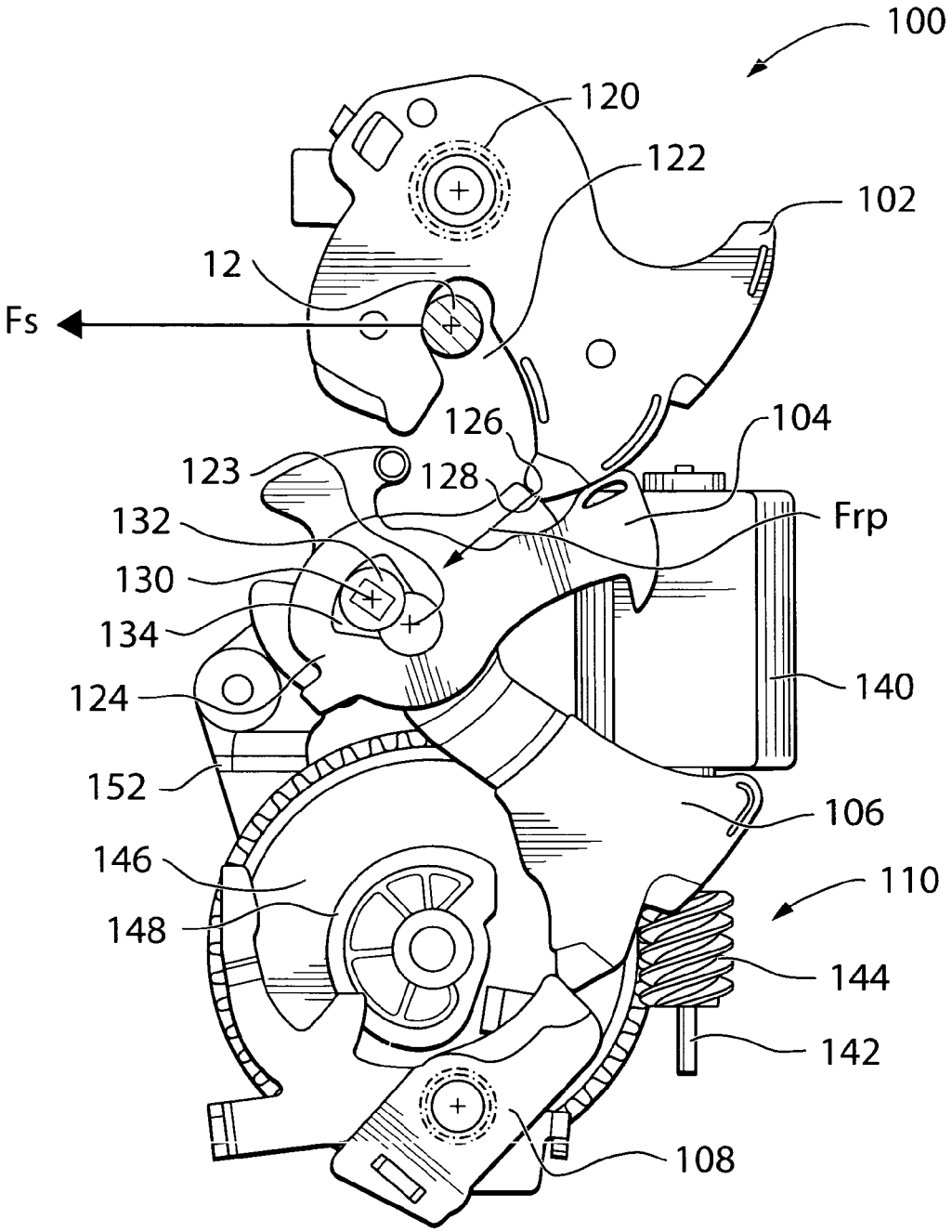
FIG. 3*a* is a side view of a first side of a vehicle latch in accordance with another embodiment of the present invention, in a latch closed position.
Figure 3B:
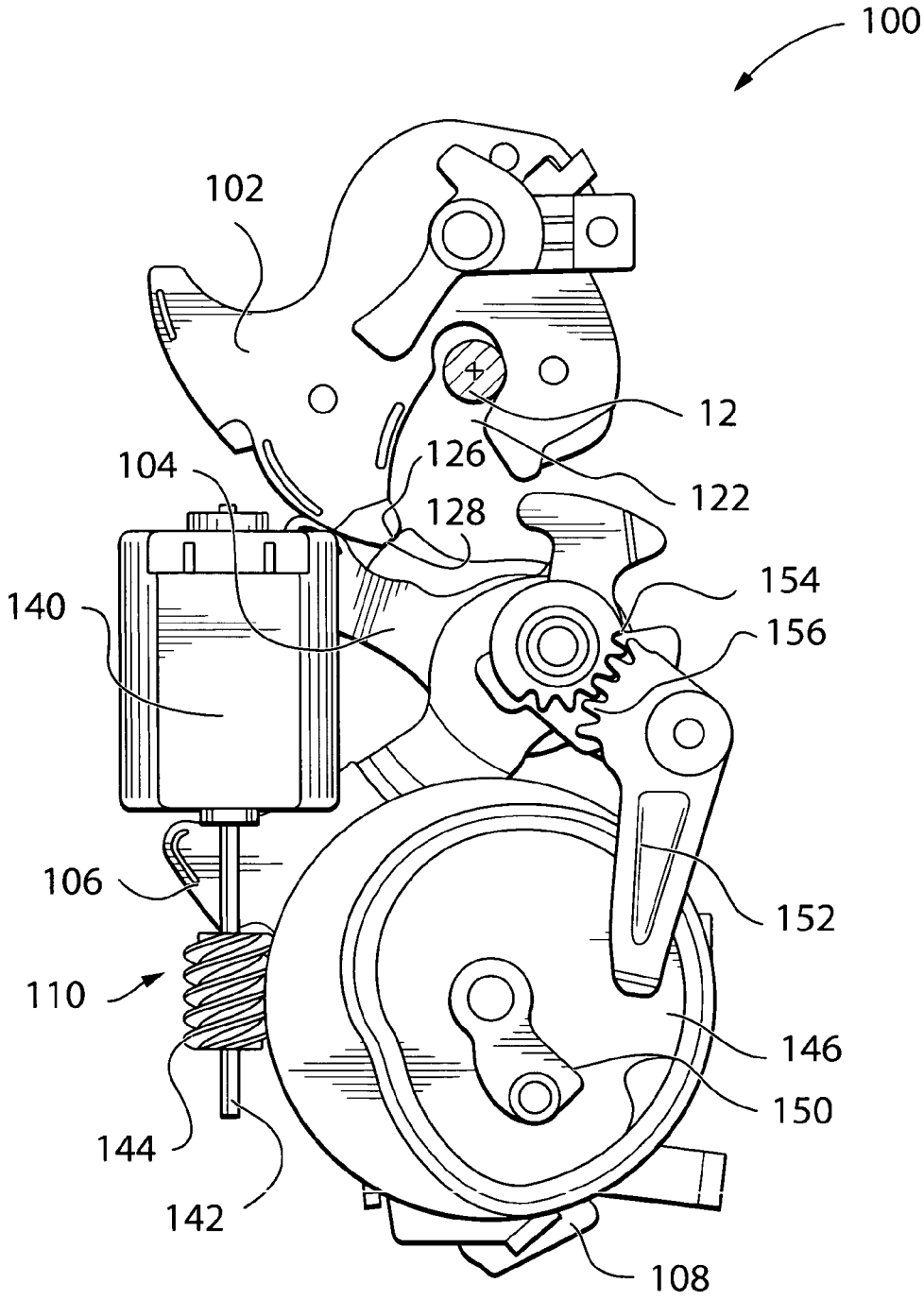
FIG. 3*b* is a side view of a second side of the vehicle latch shown in FIG. 3*a* in the latch closed position.

Reference is made to FIGS. 3*a* and 3*b*, which show a vehicle latch 100 in accordance with another embodiment of the present invention. The vehicle latch 100 includes a ratchet 102, a first pawl 104, a cam 106, a second pawl 108 and a drive mechanism 110.

Figure 4A:
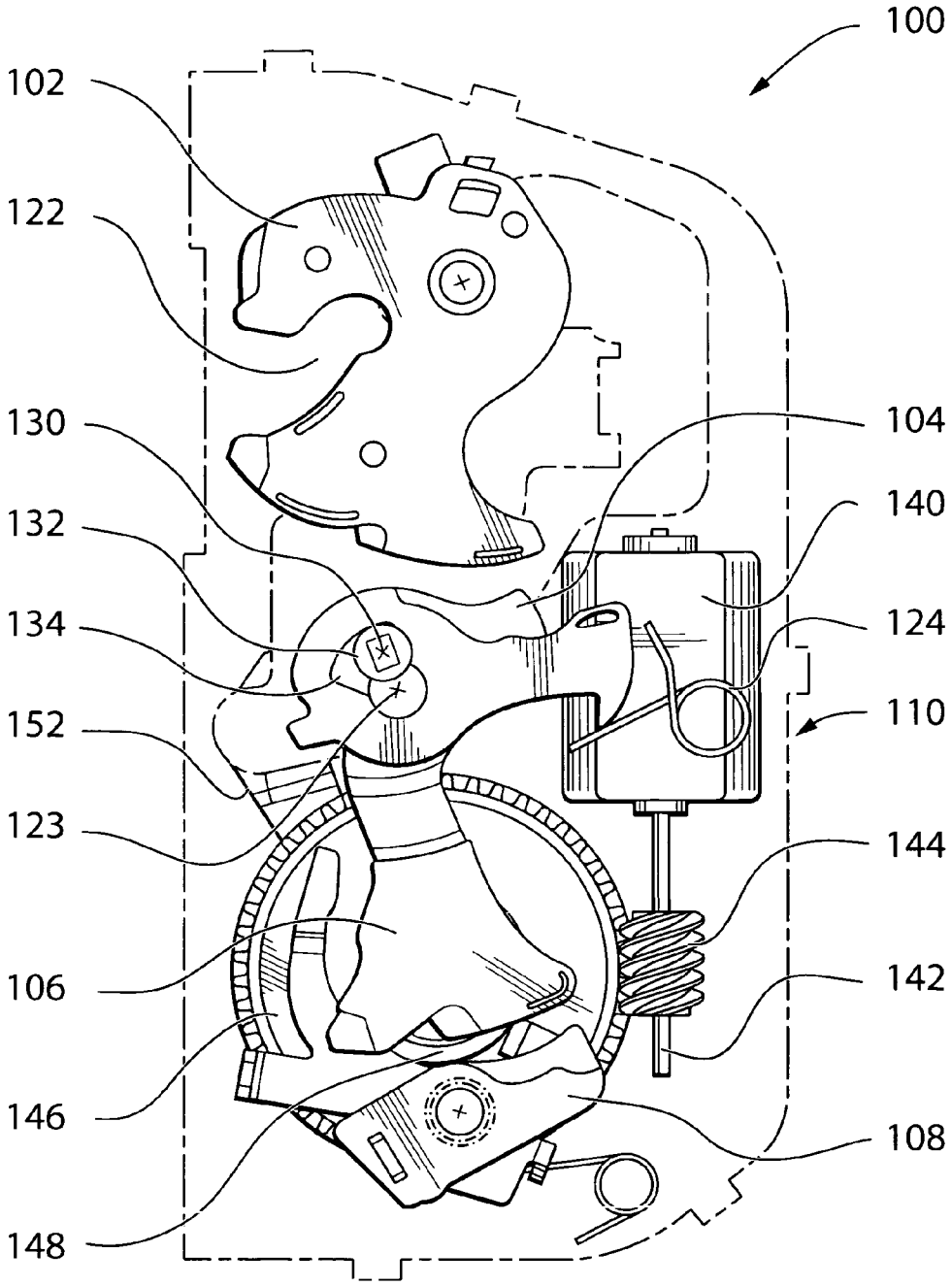
FIG. 4*a* is a side view of the first side of the vehicle latch shown in FIG. 3*a*, in a latch open position.
Figure 4B:
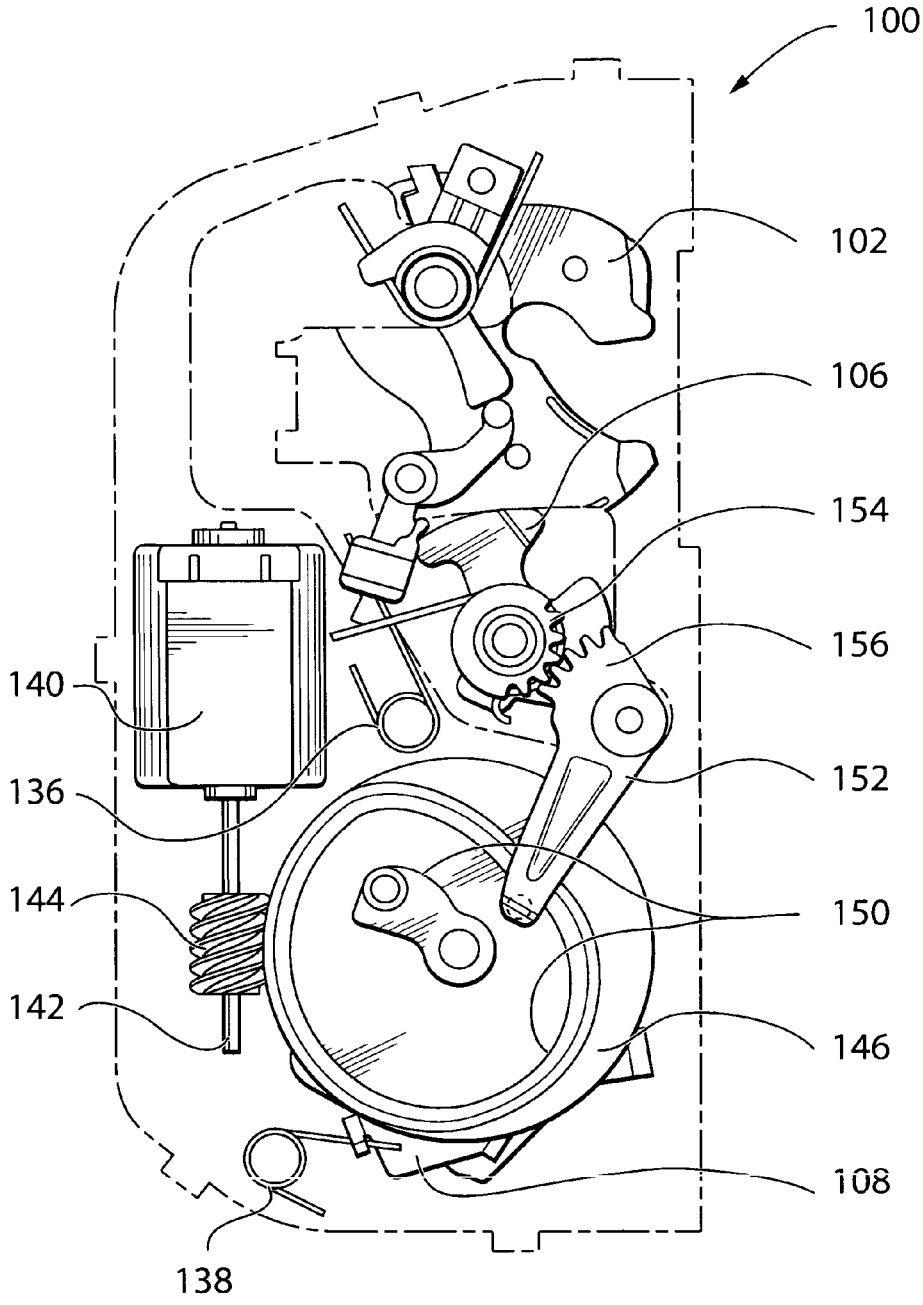
FIG. 4*b* is a side view of the second side of the vehicle latch shown in FIG. 3*a*, in the latch open position.

The ratchet 102 is pivotally movable between a striker release position (FIGS. 4*a* and 4*b*) wherein the ratchet 102 is positioned to receive the striker 12, and a striker holding position (FIGS. 3*a* and 3*b*) wherein the ratchet 102 is positioned to retain the striker 12. The ratchet 102 is biased towards the striker release position by a ratchet biasing member 120, which may be, for example, a torsion spring.

The ratchet 102 includes a slot 122 that is configured to hold the striker 12 when the ratchet 102 is in the striker holding position (FIGS. 3*a* and 3*b*), thereby preventing the striker 12 from being withdrawn from the ratchet 102. The slot 122 is also configured to cooperate with the striker 12 such that when the striker 12 is initially received in the slot 122, the striker 12 urges the rotation of the ratchet 102 towards its striker holding position. Also, when the ratchet 102 is in the striker holding position and holds the striker 102 (ie. when the vehicle door containing the vehicle latch 100 is closed), the striker 12 exerts a force Fs urging the ratchet 102 towards the striker release position. The force Fs is the result of the compression of the door seal (not shown) that takes place when the vehicle door containing the vehicle latch 100 is closed.

The first pawl 104 is pivotally movable about a first pawl pivot axis 123 between a ratchet locking position (FIG. 3*a*) wherein the first pawl 104 holds the ratchet 102 in the striker holding position, a ratchet release position (FIG. 4*a*) wherein the first pawl 104 permits the movement of the ratchet 102 out of the striker holding position, and a first pawl reset position wherein the first pawl 104 is positioned to capture and retain the ratchet 102 as the ratchet 102 moves to the striker holding position. The first pawl 104 is biased towards the first pawl closed position by a first pawl biasing member 124 (FIG. 4*a*), which may be, for example, a spring.

The first pawl 102 includes a first pawl locking surface 126 which engages a ratchet locking surface 128 on the ratchet 102 to lock the ratchet 102 in the striker holding position.

Figure 5A:
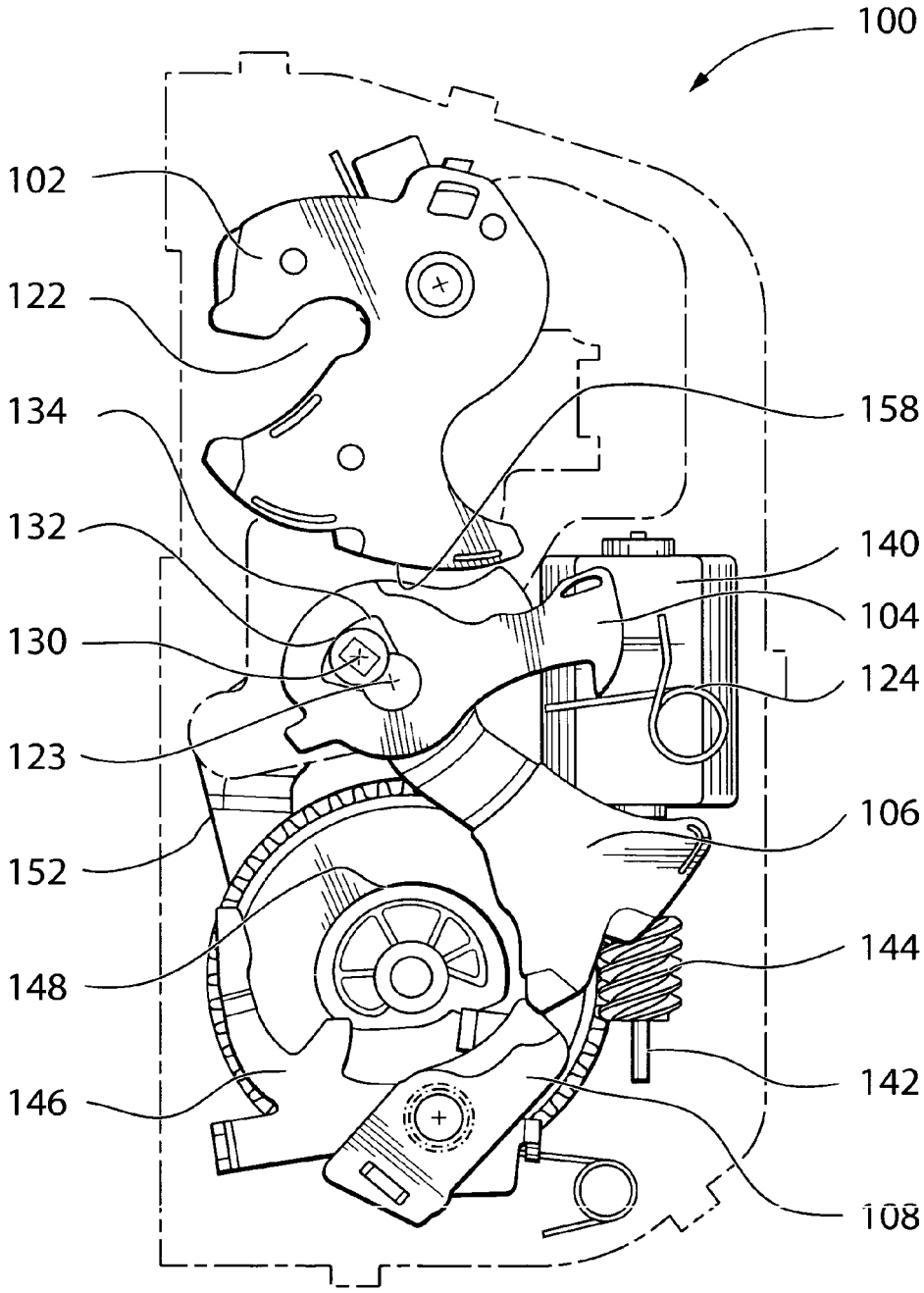
FIG. 5*a* is a side view of the first side of the vehicle latch shown in FIG. 3*a*, in a latch reset position.

The cam 106 is pivotally movable about a cam pivot axis 130 between a first pawl disabling position (FIG. 4*a*) wherein the cam 106 positions the first pawl 104 in the ratchet release position, and a first pawl enabling position as shown in FIGS. 3*a* and 5*a*. When the cam 106 is in the first pawl enabling position, the first pawl 104 is positioned to be movable between the first pawl reset position (FIG. 5*a*) and the ratchet locking position (FIG. 3*a*). As seen in FIG. 3*a*, the cam 106 includes a position limiter pin 132 that cooperates with a slot 134 on the first pawl 104 to limit the range of movement of the first pawl 104 relative to the cam 106. The cam 106 is thus operatively connected to the first pawl 104.

The cam 106 may be biased towards the first pawl disabling position by a biasing member 136 (FIG. 4*b*), which may be, for example, a torsion spring.

The second pawl 108 is pivotally movable between a cam locking position (FIG. 3*a*) wherein the second pawl 108 is positioned to hold the cam 106 in the first pawl enabling position, and a cam release position (FIG. 4*a*) wherein the second pawl 108 is positioned to permit the movement of the cam 106 out of the first pawl enabling position.

The second pawl 108 may be biased towards the cam locking position by a biasing member 138 (FIG. 4*b*), which may be, for example, a torsion spring.

Figure 6A:
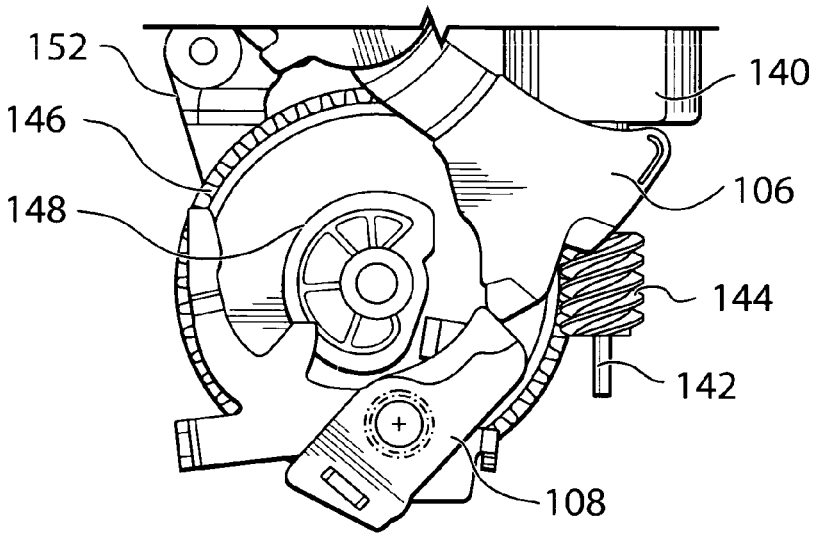
FIG. 6*a* is a side view of a first side of a portion of the vehicle latch shown in FIG. 3*a*, in the latch closed position.
Figure 6B:
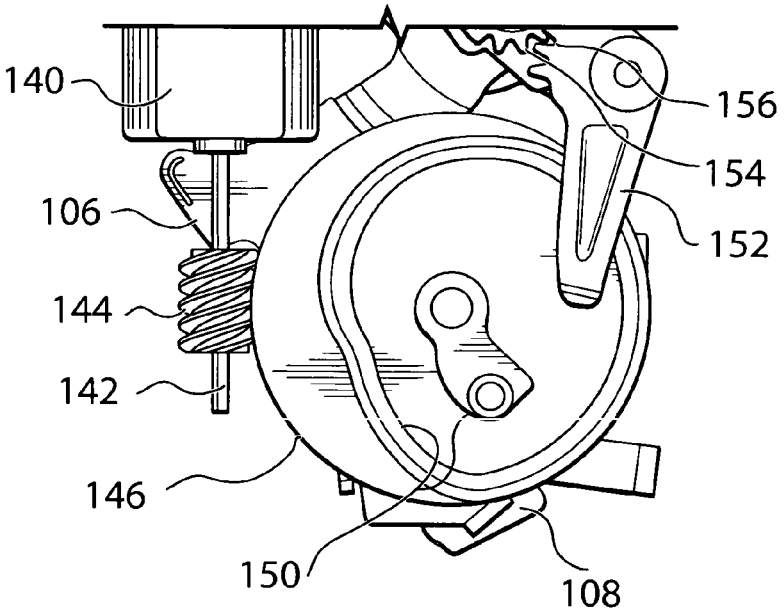
FIG. 6*b* is a side view of a second side of the portion of the vehicle latch shown in FIG. 6*a*, in the latch closed position.
Figure 7A:
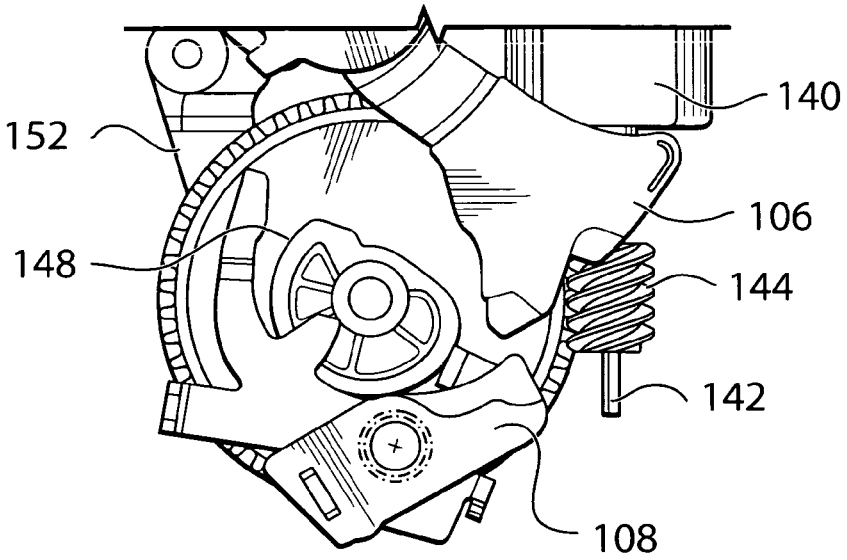
FIG. 7*a* is a side view of the first side of the portion of the vehicle latch shown in FIG. 6*a*, in an intermediate position.
Figure 7B:
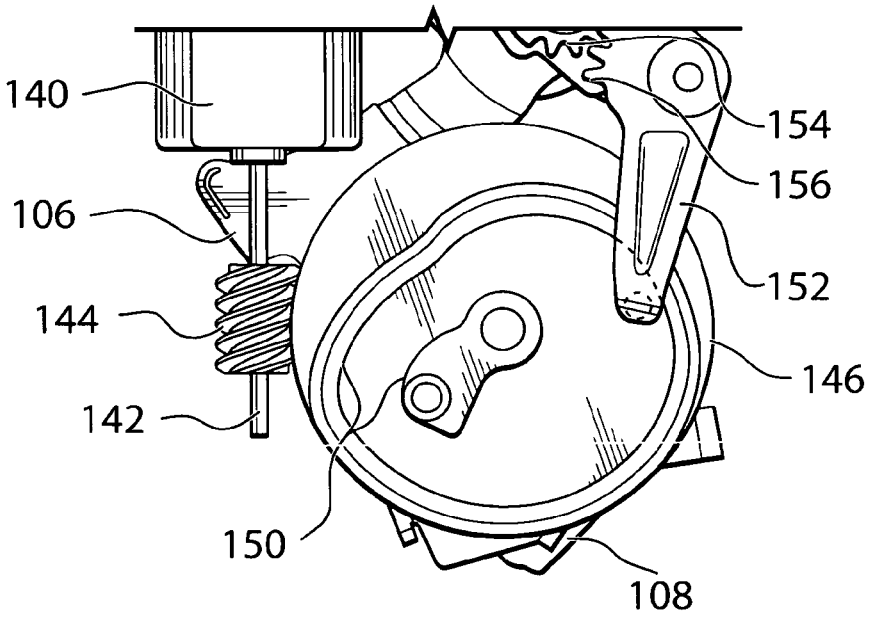
FIG. 7*b* is a side view of the second side of the portion of the vehicle latch shown in FIG. 6*a*, in the intermediate position.
Figure 8A:
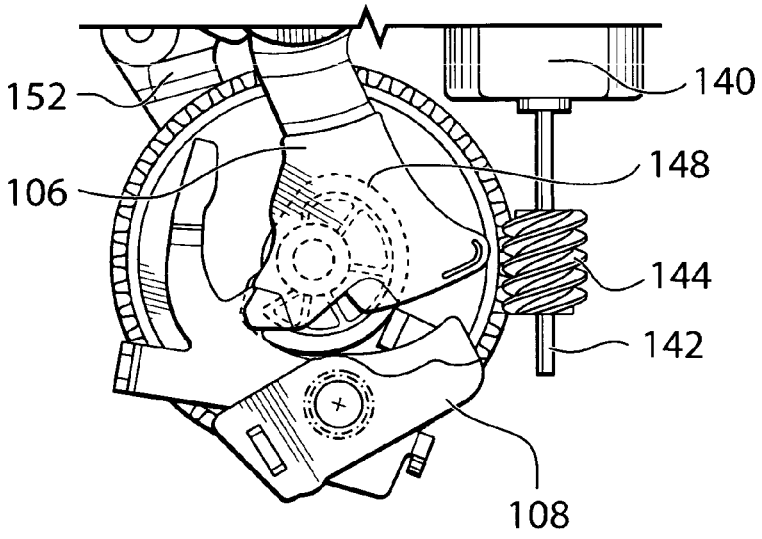
FIG. 8*a* is a side view of the first side of the portion of the vehicle latch shown in FIG. 6*a*, in a latch open position.
Figure 8B:
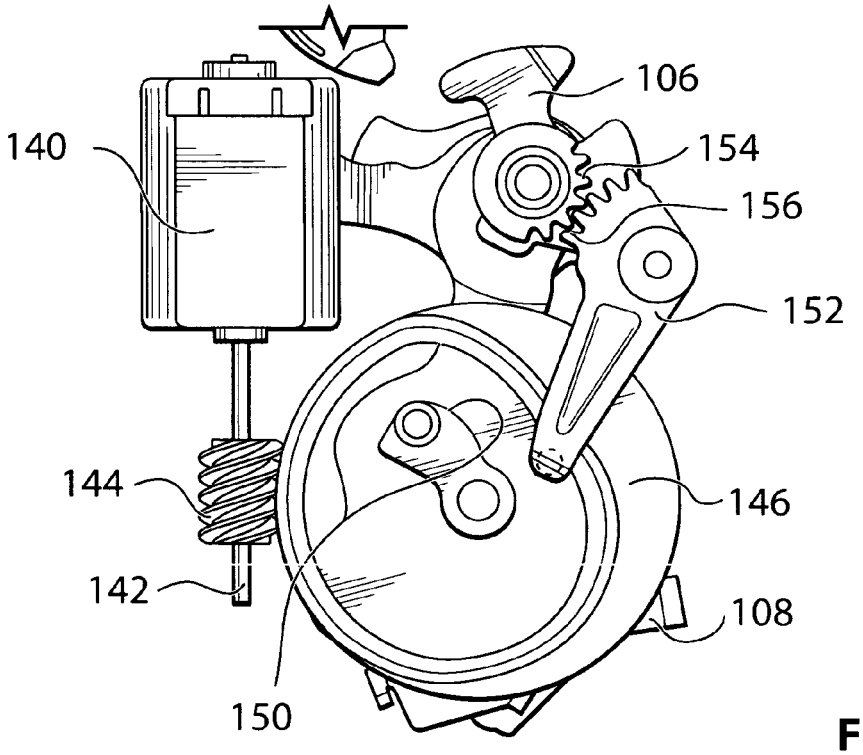
FIG. 8*b* is a side view of the second side of the portion of the vehicle latch shown in FIG. 6*a*, in the latch open position.

The drive mechanism 110 may include, for example, a motor 140 with an output shaft 142, a worm gear 144 mounted on the output shaft 142, a final gear 146, a second pawl engagement member 148 (FIG. 3*a*), which, in the embodiment shown, is a second-pawl-driving cam structure 148 on the final gear 146, a second pawl engagement member 148 (FIG. 3*b*), which, in the embodiment shown a cam-driving cam structure 150 on the final gear 146, and a cam engagement member, which in the embodiment shown in FIG. 3*b* is a gear lever 152. The drive mechanism 110 drives the operation of the second pawl 108 and the cam 106 (ie. both the release of the striker 12 from the ratchet 102 and the positioning of the first pawl 104 in the first pawl reset position) while turning the motor 140 in one direction only. The drive mechanism 110 is shown in FIGS. 6*a* and 6*b* in a first position. When the drive mechanism is in the first position, the second pawl 108 is in the cam locking position and the cam 106 is in the first pawl enabling position. As the final gear 146 is driven in a first direction (counterclockwise in FIG. 6*a*, clockwise in FIG. 6*b*), the second-pawl-driving cam structure 148 engages the second pawl 108 (FIG. 7*a*) and drives it clockwise towards its cam release position (FIG. 8*a*). When the final gear 146 reaches a final gear release position (FIGS. 8*a* and 8*b*) the motor 140 is stopped so as to hold the final gear 146 in that position until the ratchet 102 reaches the striker release position. A sensor may be provided to sense when the final gear 146 reaches the final gear release position. A control unit (not shown) may be provided to stop the motor 140 when the sensor detects that the final gear 146 has reached the final gear release position. In the final gear release position, the second-pawl-driving cam structure 148 on the final gear 146 holds the second pawl 108 in the cam release position.

As a result of the movement of the second pawl 108 to its cam release position, the cam 106 moves to its first pawl disabling position (FIG. 8*a*). The cam 106 is urged towards its first pawl disabling position at least in part by the cam biasing member 136. Additionally, with reference to FIG. 3*a*, the cam 106 may be urged towards its first pawl disabling position as a result of the force Fs exerted by the striker 12 (FIG. 3*a*) on the ratchet 102 (FIG. 3*a*). The force Fs on the ratchet 102 results in a force Frp exerted by the ratchet on the first pawl 104. The force Frp is exerted along a line of action such that it urges the cam 106 towards its first pawl disabling position. The line of action is proximate the first pawl pivot axis 123 when the vehicle latch 100 is in the closed position shown in FIG. 3*a*.

Referring to FIG. 3*b*, the cam 106 includes a cam gear 154 that meshes with gear teeth 156 on the gear lever 152. When the second pawl 108 is moved to its cam release position, if the cam 106 does not pivot from the first pawl enabling position to the first pawl disabling position under the urgings of the force Frp and the cam biasing member 136, the cam-driving cam structure 150 on the final gear 146 drives the gear lever 152 to rotate (clockwise in FIG. 6*b*), which in turn drives the cam 106 to rotate to its first pawl disabling position, which in turn brings the first pawl 104 its ratchet release position, which in turn permits the striker 12 to be released from the ratchet 102. Positively moving the cam 106 to its first pawl disabling position increases the likelihood that the striker 12 will be releasable from the ratchet 102 when the second pawl 108 is moved to its cam release position.

Figure 5B:
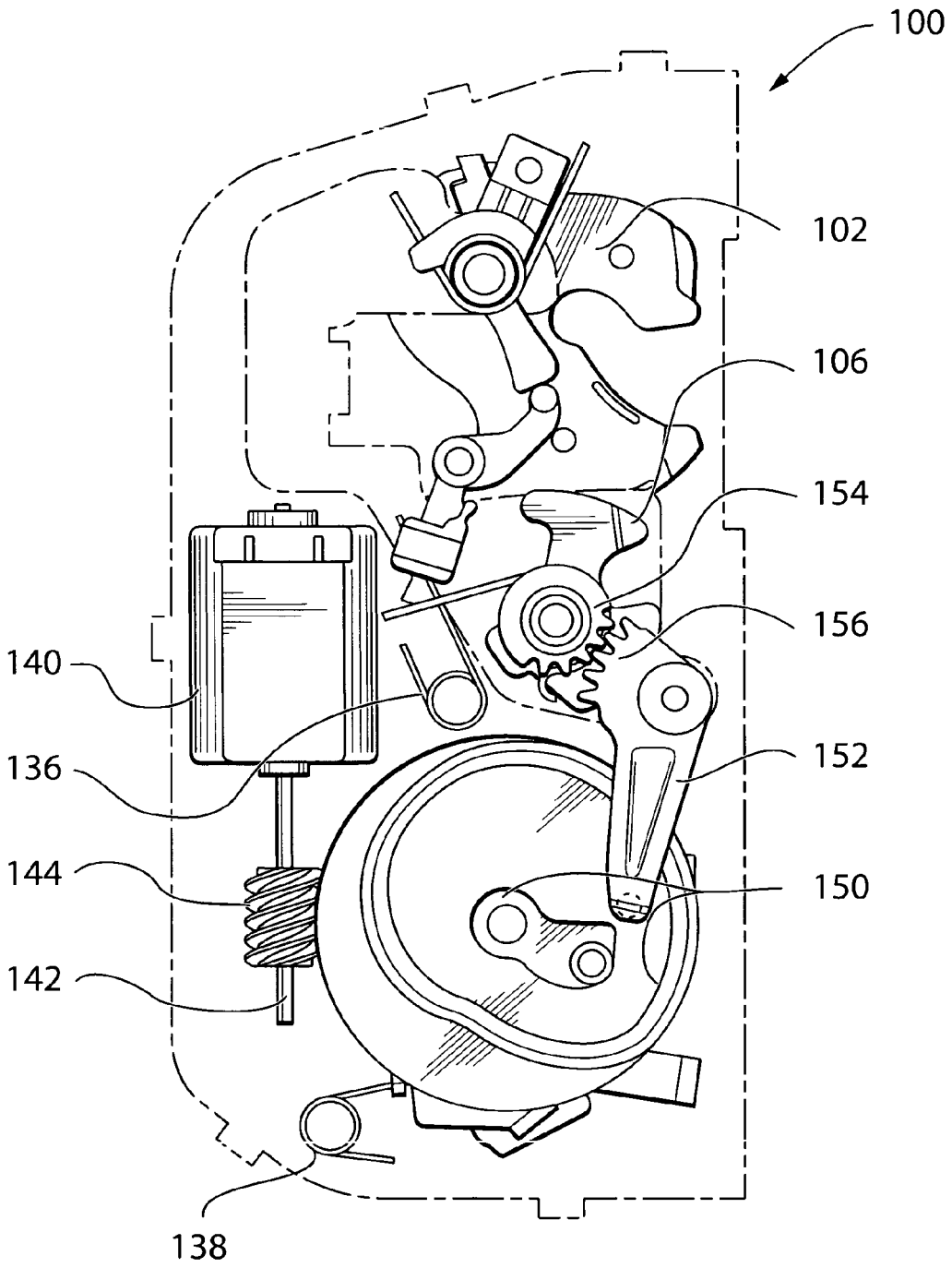
FIG. 5*b* is a side view of the second side of the vehicle latch shown in FIG. 3*a*, in the latch reset position.
Figure 9A:
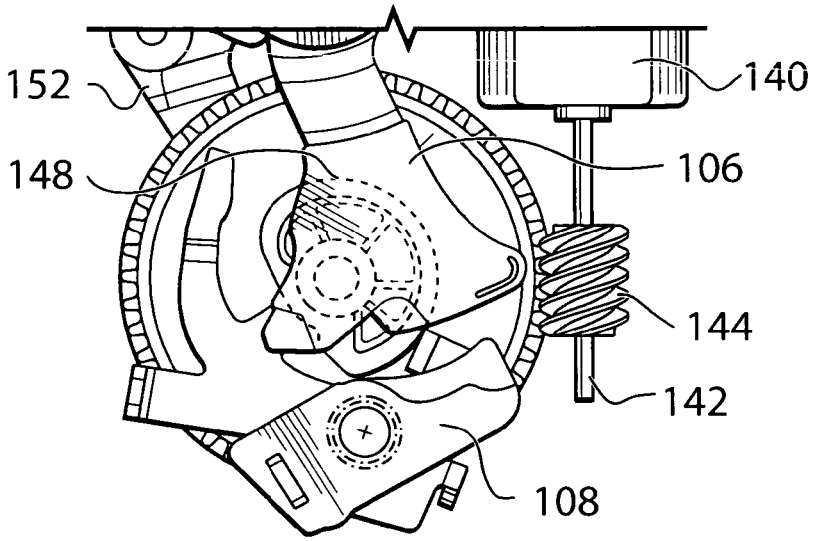
FIG. 9*a* is a side view of the first side of the portion of the vehicle latch shown in FIG. 6*a*, in a second intermediate position.
Figure 9B:
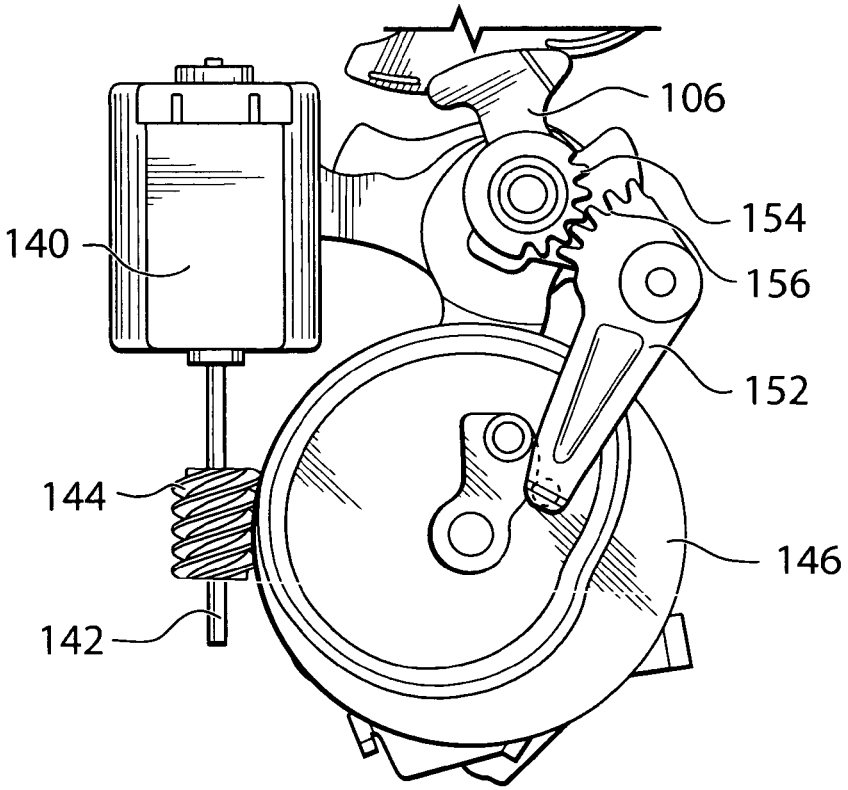
FIG. 9*b* is a side view of the second side of the portion of the vehicle latch shown in FIG. 6*a*, in the second intermediate position.
Figure 10A:
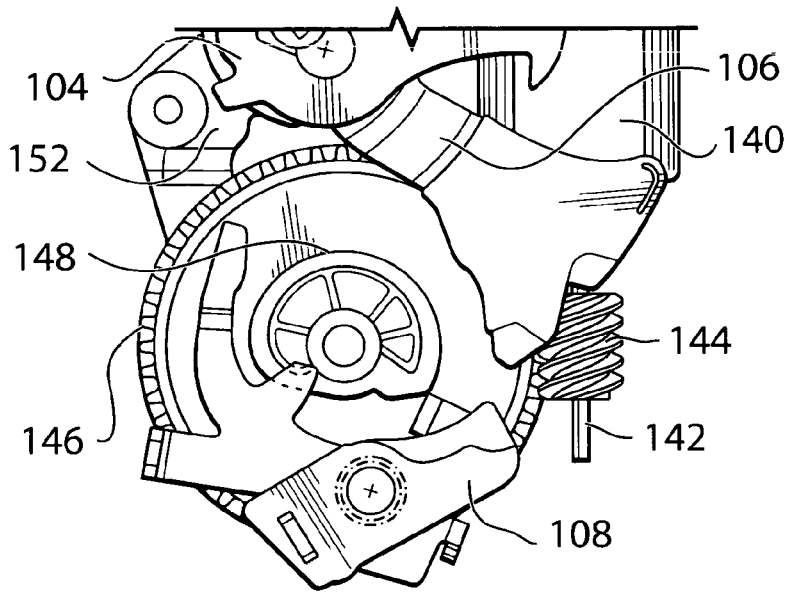
FIG. 10*a* is a side view of the first side of the portion of the vehicle latch shown in FIG. 6*a*, in a third intermediate position.
Figure 10B:
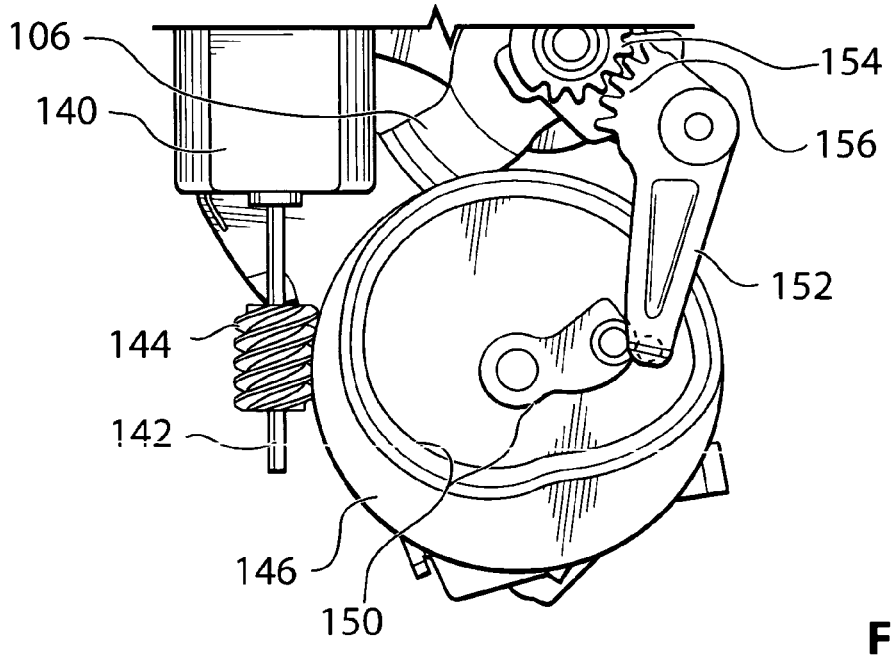
FIG. 10*b* is a side view of the second side of the portion of the vehicle latch shown in FIG. 6*a*, in the third intermediate position.
Figure 11A:
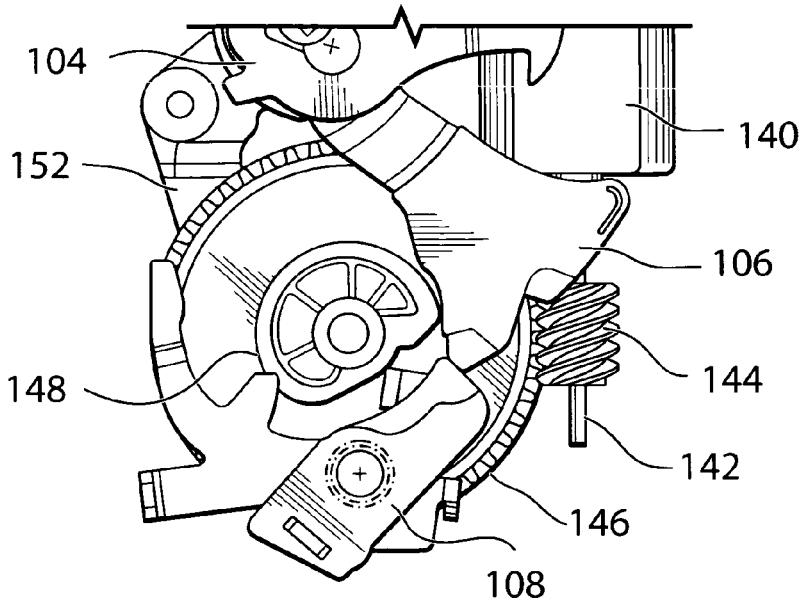
FIG. 11*a* is a side view of the first side of the portion of the vehicle latch shown in FIG. 6*a*, in a latch reset position.
Figure 11B:
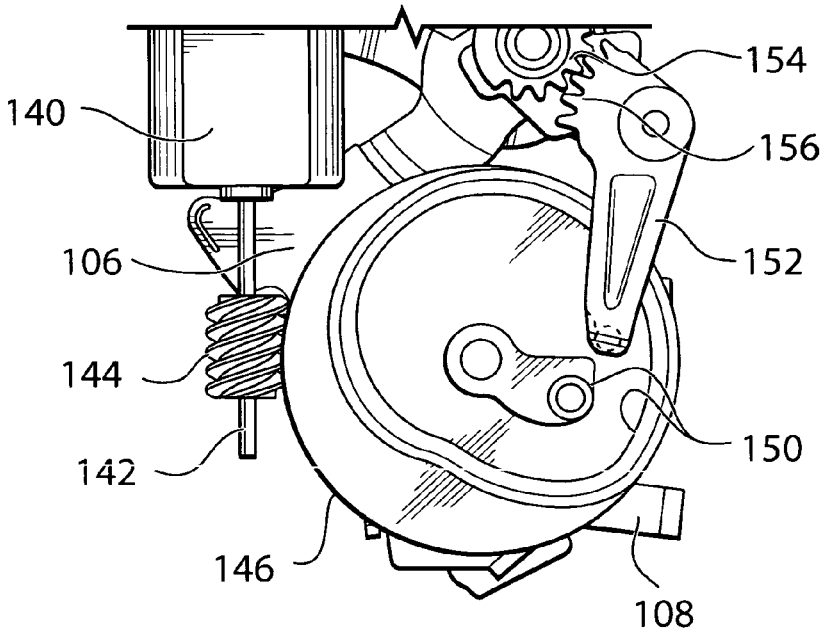
FIG. 11*b* is a side view of the second side of the portion of the vehicle latch shown in FIG. 6*a*, in the latch reset position.

After the ratchet 102 reaches the striker release position (FIG. 4*a*) to release the striker 12, the motor 140 may be operated to move the first pawl 104 to the first pawl reset position (FIG. 5*a*), wherein the first pawl 104 is positioned to capture and retain the ratchet 102 as it moves to the striker holding position. To move the first pawl 104 to the reset position, the motor 140 is driven in the same direction in which it was driven to release the striker 12. With reference to FIGS. 9*a* and 9*b*, the motor 140 is rotated so that the final gear 146 rotates (counterclockwise in FIG. 9*a*, clockwise in FIG. 9*b*). The second-pawl-driving cam structure 148 (FIG. 9*a*) on the final gear 146 holds the second pawl 108 out of the cam locking position while the cam-driving cam structure 150 (FIG. 9*b*) drives the gear lever 152 to rotate (counterclockwise in FIG. 9*b*) to drive the cam 106 to an overtravel position shown in FIGS. 10*a* and 10*b*. When the cam 106 is in its overtravel position, second-pawl-driving cam structure 148 rotates out of the way of the second pawl 108 at which point the second pawl biasing member 138 urges the second pawl 108 to its cam locking position (FIG. 11*a*). When the second pawl 108 has reached the cam locking position, the cam-driving cam structure 150 rotates out of the way of the gear lever 152, at which point, the cam biasing member 136 urges the cam 106 to its first pawl enabling position where it engages and is held by the second pawl 108. The position of the final gear 146 at which the cam 106 is permitted to move back to its first pawl enabling position is the final gear reset position. A sensor connected to the aforementioned control unit (not shown) may be provided to detect when the final gear 146 reaches the final gear reset position. Upon detecting such an event, the control unit may be programmed to stop the motor 140 thereby holding the final gear 146 in the final gear reset position until such time as the user wants to open the vehicle door. When the cam 106 is brought to its first pawl enabling position, the first pawl 104 is brought to the first pawl reset position, where it is engaged with a ratchet camming surface 158 on the open ratchet 102 (FIG. 5*a*) in a way where the first pawl 104 permits rotation of the ratchet 102 to the striker holding position. The position of the vehicle latch 100 shown in FIGS. 5*a* and 5*b* is the latch reset position.

When the vehicle door (not shown) is closed while the latch 100 is in the latch reset position, the striker 12 engages the ratchet 102 and drives the ratchet 102 to (and slightly past) its closed position, at which point, the first pawl 104 is urged to its ratchet locking position by the first pawl biasing member 124. The ratchet 102 is brought to its striker holding position where it engages the first pawl 104 under the urging of the striker 12 as a result of the compression of the door seal (not shown) and the urging of the ratchet biasing member 120, at which point the vehicle latch 100 is in the latch closed position (FIG. 3*a*).

There are several advantages to the vehicle latch 100 relative to other vehicle latches. For example, the vehicle latch 100 incorporates a motor (the motor 140) that is run in one direction only instead of bi-directional rotation. As a result, the reliability of the vehicle latch 100 may be superior. This is because bi-directional rotation of a motor and associated drive mechanism components can be inherently more stressful than unidirectional rotation. Furthermore the vehicle latch 100 is configured so that the motor 140 is not driven in a stalled condition as a result of a driven component engaging a limit surface. As a result of not operating the motor 140 in a stalled condition there is reduced current absorption and reduced electrical noise by the motor 140 during use, relative to vehicle latches where a drive motor drives a component until the component encounters a limit surface. Also, the reduction in the number of components abruptly encountering limit surfaces reduces the amount of mechanical noise associated with the vehicle latch 100 relative to some other latches. Furthermore, the reduction of situations wherein latch components abruptly encounter limit surfaces reduces the stresses on the components, thereby further increasing the reliability of the vehicle latch 100.

Additionally, uni-directional rotation of the motor 10 simplifies the complexity of the control unit that is used to control the operation of the motor 140 relative to control units for bi-directional rotation of a motor.

Figure 12:
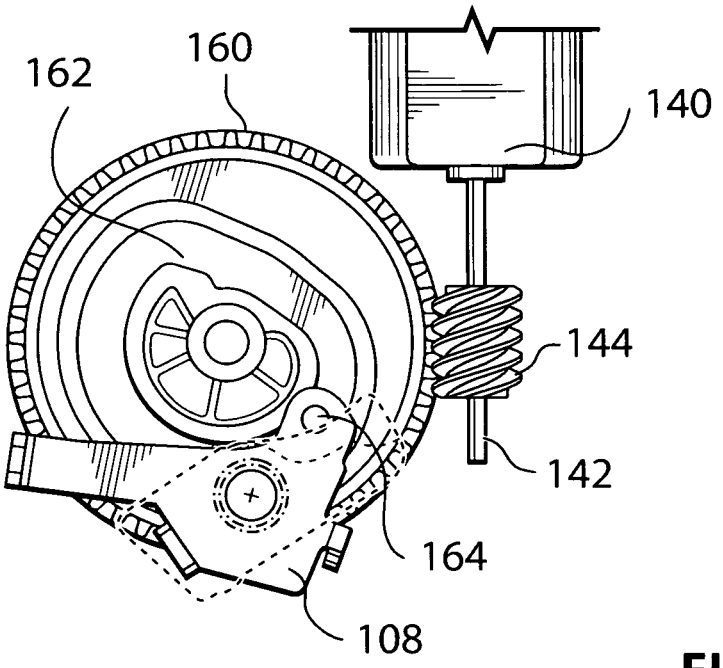
FIG. 12 is a side view of an alternative final gear that may be used with the vehicle latch shown in FIG. 3*a*.

Reference is made to FIG. 12, which shows a final gear 160 that can be used instead of the final gear 146. The final gear 160 may be similar to the final gear 146 (FIG. 3*a*) except that the final gear 160 may include a second-pawl-driving cam structure 162 that positively controls the movement of the second pawl 108 throughout the entire rotation of the final gear 160. More specifically, the second-pawl-driving cam structure 148 (FIG. 3*a*) positively controls the movement of the second pawl 108 throughout a portion of the rotation of the final gear 146 (as shown, for example in FIGS. 7*a* and 8*a*). However, the position of the second pawl 108 when the second-pawl-driving cam structure 148 is at one of the rotational positions shown in FIGS. 6*a* and 11*a* for example, is controlled in part by the second pawl biasing member 138. By providing the second-pawl-driving cam structure 162, which is a channel that extends throughout a complete rotation of the final gear 160 which slidably receives a pin 164 that extends outwardly from the second pawl 108, the second pawl biasing member 138 (FIG. 4*b*) may be omitted.

While the above description constitutes a plurality of embodiments of the present invention, it will be appreciated that the present invention is susceptible to further modification and change without departing from the fair meaning of the accompanying claims.

The invention claimed is:

1. A vehicle latch, comprising: a ratchet movable between a striker release position wherein the ratchet is positioned to receive a striker and a striker holding position wherein the ratchet is positioned to retain the striker; a ratchet biasing member biasing the ratchet towards the striker release position; a first pawl movable between a ratchet locking position wherein the first pawl is positioned to hold the ratchet in the striker holding position and a ratchet release position wherein the first pawl permits the movement of the ratchet out of the striker holding position; a first pawl biasing member biasing the first pawl towards the ratchet locking position; a cam operatively connected to the first pawl, the cam being movable about a cam axis between a first pawl enabling position in which the first pawl is enabled to move to the ratchet locking position and a first pawl disabling position in which the cam positions the first pawl in the ratchet release position; a cam biasing member biasing the cam towards the first pawl disabling position; a second pawl movable about a second pawl pivot axis between a cam locking position in which the second pawl is positioned to hold the cam in the first pawl enabling position and a cam release position in which the second pawl is positioned to permit the movement of the cam to the first pawl disabling position, the second pawl pivot axis being offset from the cam axis; a drive mechanism configured for moving the second pawl to the cam release position; and wherein the drive mechanism includes a plurality of gears including a final gear, wherein the final gear has thereon a second pawl engagement member positioned for moving the second pawl out of engagement with the cam.

2. A vehicle latch as claimed in claim 1, wherein the first pawl is pivotally mounted to the cam.

3. A vehicle latch as claimed in claim 1, wherein the cam is pivotable about the cam axis, and wherein the first pawl is pivotally mounted to the cam about a first pawl axis, wherein the first pawl axis is offset from the cam axis.

4. A vehicle latch as claimed in claim 3, wherein, in use, the ratchet is engageable with the striker to receive a door seal force from the striker, wherein, when the first pawl is in the ratchet locking position the ratchet is positioned to receive the door seal force and to transmit a corresponding second force in a second force direction that is approximately intersectant with the first pawl axis.

5. A vehicle latch as claimed in claim 4, wherein the corresponding second force is transmittable from the first pawl into the cam in such a way as to generate a moment that urges the cam towards the first pawl disabling position.

6. A vehicle latch as claimed in claim 1, wherein the drive mechanism includes a motor, and the plurality of gears are drivable by the motor.

7. A vehicle latch as claimed in claim 6, wherein the drive mechanism includes a cam engagement member positioned for moving the cam towards the first pawl enabling position.

8. A vehicle latch as claimed in claim 1, wherein, when the ratchet is in the striker holding position, the final gear is movable to a position wherein the second pawl engagement member is engaged with the second pawl so that movement of final gear in a first direction substantially immediately initiates movement of the second pawl out of the cam locking position.

9. A vehicle latch as claimed in claim 1, wherein the final gear has thereon a cam engagement member positioned for moving the cam towards the first pawl enabling position, and wherein, when the ratchet is in the striker holding position, rotation of the final gear in a first direction moves the second pawl engagement member in a direction to move the second pawl out of the cam locking position and moves the first pawl disablement surface in a direction to move the cam out of the first pawl enabling position.

10. A vehicle latch as claimed in claim 9, wherein the final gear has thereon a first pawl disablement drive surface positioned for moving the cam towards the first pawl disabling position, and wherein, when the cam is in the first pawl disabling position, rotation of the final gear in a second direction moves the first pawl enablement surface in a direction to move the cam to the first pawl enabling position.

11. A vehicle latch as claimed in claim 10, wherein movement of the cam to the first pawl enabling position causes the second pawl to move to the cam locking position.

12. A vehicle latch as claimed in claim 11, wherein the ratchet is movable from the striker release position to the striker holding position when the cam is in the first pawl enabling position.

13. A vehicle latch as claimed in claim 12, wherein movement of the ratchet to the striker holding position causes the first pawl to move to the ratchet locking position.

14. A vehicle latch as claimed in claim 1, wherein the drive mechanism includes a motor and a second pawl driving cam structure that is driven by unidirectional rotation of the motor and that is configured to drive the second pawl from the cam locking position to the cam release position and from the cam release position to the cam locking position.

15. A vehicle latch as claimed in claim 1, including a second pawl biasing member biasing the second pawl towards the cam locking position.

16. A vehicle latch, comprising: a ratchet movable between a striker release position wherein the ratchet is positioned to receive a striker and a striker holding position wherein the ratchet is positioned to retain the striker; a ratchet biasing member biasing the ratchet towards the striker release position; a first pawl movable between a ratchet locking position wherein the first pawl is positioned to hold the ratchet in the striker holding position and a ratchet release position wherein the first pawl permits the movement of the ratchet out of the striker holding position; a first pawl biasing member biasing the first pawl towards the ratchet locking position; a cam operatively connected to the first pawl, the cam being movable about a cam axis between a first pawl enabling position in which the first pawl is enabled to move to the ratchet locking position and a first pawl disabling position in which the cam positions the first pawl in the ratchet release position; a cam biasing member biasing the cam towards the first pawl disabling position; a second pawl movable about a second pawl pivot axis between a cam locking position in which the second pawl is positioned to hold the cam in the first pawl enabling position and a cam release position in which the second pawl is positioned to permit the movement of the cam to the first pawl disabling position, the second pawl pivot axis being offset from the cam axis; a drive mechanism configured for moving the second pawl to the cam release position; and wherein the drive mechanism includes a plurality of gears including a final gear, wherein the final gear has thereon a first pawl disablement drive surface positioned for moving the cam towards the first pawl disabling position.

17. A vehicle latch as claimed in claim 16, wherein the first pawl is pivotally mounted to the cam.

18. A vehicle latch as claimed in claim 16, wherein the cam is pivotable about the cam axis, and wherein the first pawl is pivotally mounted to the cam about a first pawl axis, wherein the first pawl axis is offset from the cam axis.

19. A vehicle latch as claimed in claim 18, wherein, in use, the ratchet is engageable with the striker to receive a door seal force from the striker, wherein, when the first pawl is in the ratchet locking position the ratchet is positioned to receive the door seal force and to transmit a corresponding second force in a second force direction that is approximately intersectant with the first pawl axis.

20. A vehicle latch as claimed in claim 19, wherein the corresponding second force is transmittable from the first pawl into the cam in such a way as to generate a moment that urges the cam towards the first pawl disabling position.

21. A vehicle latch as claimed in claim 16, wherein the drive mechanism includes a motor, and the plurality of gears are drivable by the motor.

22. A vehicle latch as claimed in claim 16, wherein the drive mechanism includes a cam engagement member positioned for moving the cam towards the first pawl enabling position.

23. A vehicle latch as claimed in claim 16, wherein the drive mechanism includes a motor and a second pawl driving cam structure that is driven by unidirectional rotation of the motor and that is configured to drive the second pawl from the cam locking position to the cam release position and from the cam release position to the cam locking position.

24. A vehicle latch as claimed in claim 16, including a second pawl biasing member biasing the second pawl towards the cam locking position.

25. A vehicle latch, comprising: a ratchet movable between a striker release position wherein the ratchet is positioned to receive a striker and a striker holding position wherein the ratchet is positioned to retain the striker; a ratchet biasing member biasing the ratchet towards the striker release position; a first pawl movable between a ratchet locking position wherein the first pawl is positioned to hold the ratchet in the striker holding position and a ratchet release position wherein the first pawl permits the movement of the ratchet out of the striker holding position; a first pawl biasing member biasing the first pawl towards the ratchet locking position; a cam operatively connected to the first pawl, the cam being movable about a cam axis between a first pawl enabling position in which the first pawl is enabled to move to the ratchet locking position and a first pawl disabling position in which the cam positions the first pawl in the ratchet release position; a cam biasing member biasing the cam towards the first pawl disabling position; a second pawl movable about a second pawl pivot axis between a cam locking position in which the second pawl is positioned to hold the cam in the first pawl enabling position and a cam release position in which the second pawl is positioned to permit the movement of the cam to the first pawl disabling position, the second pawl pivot axis being offset from the cam axis; a drive mechanism configured for moving the second pawl to the cam release position; wherein the drive mechanism includes a second pawl driving cam structure that is configured to drive the second pawl from the cam locking position to the cam release position; and including a second pawl biasing member biasing the second pawl towards the cam locking position, and wherein the second pawl driving cam structure is configured to permit the second pawl from the cam release position to the cam locking position.

26. A vehicle latch as claimed in claim 25, wherein the drive mechanism includes a motor and the second pawl driving cam structure is driven by the motor.

27. A vehicle latch as claimed in claim 25, wherein the first pawl is pivotally mounted to the cam.

28. A vehicle latch as claimed in claim 25, wherein the cam is pivotable about the cam axis, and wherein the first pawl is pivotally mounted to the cam about a first pawl axis, wherein the first pawl axis is offset from the cam axis.

29. A vehicle latch as claimed in claim 28, wherein, in use, the ratchet is engageable with the striker to receive a door seal force from the striker, wherein, when the first pawl is in the ratchet locking position the ratchet is positioned to receive the door seal force and to transmit a corresponding second force in a second force direction that is approximately intersectant with the first pawl axis.

30. A vehicle latch as claimed in claim 29, wherein the corresponding second force is transmittable from the first pawl into the cam in such a way as to generate a moment that urges the cam towards the first pawl disabling position.

31. A vehicle latch as claimed in claim 25, wherein the drive mechanism includes a cam engagement member positioned for moving the cam towards the first pawl enabling position.

32. A vehicle latch as claimed in claim 25, wherein the drive mechanism includes a motor and a second pawl driving cam structure that is driven by unidirectional rotation of the motor and that is configured to drive the second pawl from the cam locking position to the cam release position and from the cam release position to the cam locking position.

* * * * *